US010962242B1

(12) United States Patent
Weems

(10) Patent No.: US 10,962,242 B1
(45) Date of Patent: Mar. 30, 2021

(54) SYSTEMS FOR WORKSTATION-MOUNTED RADIANT PANELS

(71) Applicant: United Services Automobile Association (USAA), San Antonio, TX (US)

(72) Inventor: John Andrew Weems, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 72 days.

(21) Appl. No.: 16/166,992

(22) Filed: Oct. 22, 2018

Related U.S. Application Data

(60) Provisional application No. 62/588,781, filed on Nov. 20, 2017.

(51) Int. Cl.
*F24F 3/08* (2006.01)
*F24F 5/00* (2006.01)
*F25D 17/02* (2006.01)

(52) U.S. Cl.
CPC ..... *F24F 3/08* (2013.01); *F24F 5/0003* (2013.01); *F25D 17/02* (2013.01); *F24F 2005/0025* (2013.01)

(58) Field of Classification Search
CPC .... F24F 3/08; F24F 5/0003; F24F 2005/0025; F25D 17/02
See application file for complete search history.

(56) References Cited

U.S. PATENT DOCUMENTS 4,872,397 A * 10/1989 Demeter ..... F24F 1/00 454/229
6,318,113 B1 * 11/2001 Levy ..... F24F 3/044 454/306
6,453,993 B1 * 9/2002 Bujak, Jr. ..... F24F 11/83 165/208
10,620,645 B2 * 4/2020 Clark ..... F24F 11/30
2005/0217540 A1 * 10/2005 Novak ..... A47B 83/001 108/50.01

(Continued)

FOREIGN PATENT DOCUMENTS

CN 209569849 U * 11/2019
JP 2012247117 A * 12/2012

OTHER PUBLICATIONS

Li, S., Water-cooling heating desk, Mar. 23, 2013, English translation of Chines patent document CN 203252184 U. (Year: 2013).*

(Continued)

*Primary Examiner* — Marc E Norman
(74) *Attorney, Agent, or Firm* — Fletcher Yoder, P.C.

(57) ABSTRACT

A workstation cooling system includes a radiant panel configured to be disposed in a workstation. The workstation cooling system also includes a water supply conduit configured to provide a cooling water flow to an inlet of the radiant panel and a water return conduit configured to receive the cooling water flow from an outlet of the radiant panel. The workstation cooling system additionally includes a control valve configured to receive control signals to adjust the cooling water flow provided to the radiant panel to enable the radiant panel to absorb heat to maintain a target temperature of the workstation.

20 Claims, 5 Drawing Sheets

(56) References Cited

U.S. PATENT DOCUMENTS

| | | | | |
|---|---|---|---|---|
| 2008/0281472 | A1* | 11/2008 | Podgorny | G05B 15/02 700/276 |
| 2011/0112693 | A1* | 5/2011 | Ye | G05B 15/02 700/277 |
| 2014/0048244 | A1* | 2/2014 | Wallace | F24F 11/30 165/253 |
| 2016/0025362 | A1* | 1/2016 | Martindale | F24F 11/70 236/49.3 |

OTHER PUBLICATIONS

Mustakallio, Panu et al., Thermal Conditions in a Simulated Office Environment with Convective and Radiant Cooling Systems, International Centre for Indoor Environment and Energy, DTU Civil Engineering, Technical University of Denmark, pp. 1-10, Lyngby, Denmark.

* cited by examiner

SYSTEMS FOR WORKSTATION-MOUNTED RADIANT PANELS

CROSS REFERENCE TO RELATED APPLICATION

This application claims priority to and the benefit of U.S. Provisional Application No. 62/588,781, entitled "SYSTEMS AND METHODS FOR WORKSTATION-MOUNTED RADIANT PANELS," filed Nov. 20, 2017, which is hereby incorporated by reference in its entirety for all purposes.

BACKGROUND

The present disclosure relates generally to systems for workstation-mounted radiant panels. More specifically, the present disclosure relates to employing radiant panels near a workstation to absorb radiant energy to maintain a target temperature at the workstation.

Traditional heating, ventilation, and air conditioning (HVAC) systems may condition a room having one or more workstations to be at a target temperature. However, the target temperature may not be individually adjustable on a workstation level, instead maintaining the entire room at a common temperature. The common temperature may cause some users to be warmer than desired, while causing other users to be cooler than desired, thus limiting a comfort and a working efficiency for the users in the room. For example, individual users may desire to cool down after being in a warm external environment, or individual users may feel that their workstation is cooler than desired.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
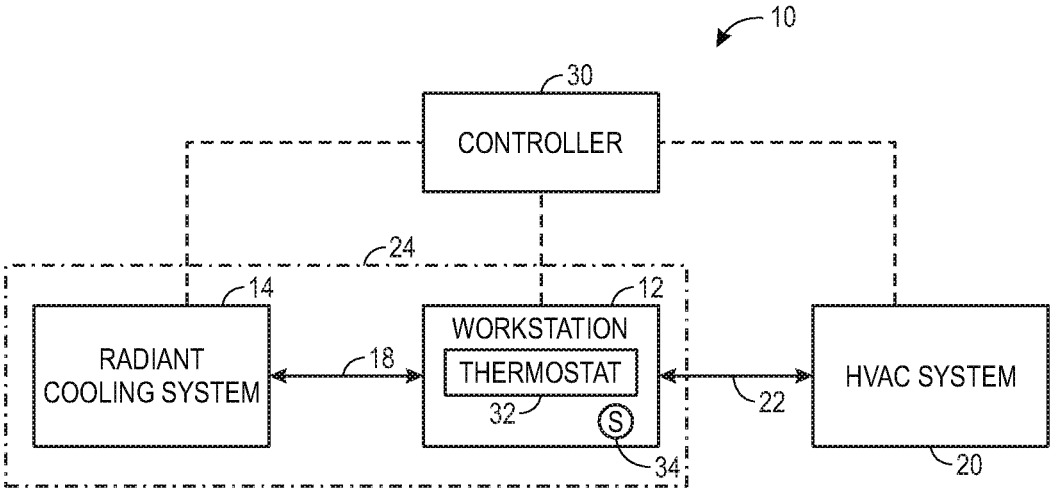
FIG. 1 illustrates a block diagram of a workstation cooling system for conditioning a workstation, in accordance with embodiments described herein.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure relates generally to a workstation cooling system that uses radiant panels near a workstation to absorb radiant energy from the workstation and other nearby energy sources, such as users, lights, equipment, and the like. As such, the workstation cooling system may enable users to maintain their individual workstation at a desired target temperature that suits their individual preferences. Further, the present embodiments of the workstation cooling system may reduce radiant energy from a lower portion of a room where the workstation is disposed, and may effectively operate in conjunction with displacement heating, ventilation, and air conditioning (HVAC) systems that supply conditioned air to the lower portion of the room.

With the foregoing in mind, in certain embodiments, a workstation cooling system employs work-station mounted radiant panels to individually condition the air near each workstation. The radiant panels may be incorporated in or replace acoustic or privacy panels of the workstation. In some embodiments, the radiant panels may be embedded within a desk or work surface of the workstation. As such, the radiant panels may be located within a close proximity to the user of the workstation, and are therefore well-suited to remove radiant energy from the workstation and provide cooler temperatures near the user. In certain embodiments, one or more radiant panels may include a heat exchange coil extending within a housing. Thus, a controller of the workstation cooling system may instruct a control valve to open to provide cooling water through the heat exchange coil of the one or more radiant panels. The user may therefore provide input to the controller through a user device, such as a desk-mounted thermostat, to adjust a flowrate of the cooling water through the heat exchange coil of the one or more radiant panels disposed in the workstation. The radiant panels may also condition the air at the workstation via convection, thus further conditioning the workstation and the room. As such, by having one or more radiant panels at a workstation, the user may adjust the target temperature for his or her workstation to be suited to his or her individual preferences, while reducing a dependence on air-mixing HVAC systems that may spread contaminants between users in the room. Additional details regarding the workstation cooling system and various methods for operating the workstation cooling system will be described below with reference to FIGS. 1-5.

By way of introduction, FIG. 1 illustrates a block diagram of a workstation cooling system 10 for conditioning a workstation 12, in accordance with embodiments described herein. As illustrated, the workstation cooling system 10 includes a radiant cooling system 14 that enables the transfer of radiant energy 18 from the workstation 12 to the radiant cooling system 14. The radiant cooling system 14 may receive the radiant energy 18 from radiant energy sources near the workstation 12 when cooling of the workstation is requested. The radiant cooling system 14 may additionally or alternatively send the radiant energy 18 to any suitable radiant energy sinks when the workstation cooling system 10 is instead operated as a workstation heating system. The workstation cooling system 10 may include an HVAC system 20 that operates to provide conditioned air 22 to a room 24 in which the workstation 12 is disposed. The conditioned air 22 may be cooled, heated, dehumidified, and/or humidified based on a selected operating mode of the HVAC system 20. However, in some embodiments, the HVAC system 20 may be omitted from the workstation cooling system 10.

In general, the workstation 12 is a desk or office space in which a user performs work. For example, the workstation 12 may be a desk, a cubicle, and the like. As such, the user may spend a significant amount of time at the workstation 12, releasing thermal and/or radiant energy and increasing a demand for cooling for the workstation 12. Additionally, in certain embodiments, multiple workstations 12 may be disposed within the room 24, and users respectively associated with the multiple workstations 12 may prefer their workstation 12 to be maintained at individualized target temperatures. As such, present embodiments of the workstation cooling system 10 enable individualized temperature settings for multiple workstations 12 in a room 24 by locating one or more radiant cooling system 14 near each of the workstations 12.

Moreover, as shown in FIG. 1, a controller 30 may be communicatively coupled to a thermostat 32 disposed within the workstation 12. The thermostat 32 enables the user to provide user input to the controller 30, which adjusts the target temperature of the workstation 12. That is, the controller 30 may be communicatively coupled to the radiant cooling system 14 and the HVAC system 20. As such, based on input received from the thermostat 32, the controller 30 may adjust one or more operating parameters of the radiant cooling system 14 and/or one or more operating parameters of the HVAC system 20 to maintain the target temperature of the workstation 12 within a threshold from the target temperature, as discussed in more detail below. Moreover, in some embodiments, a temperature sensor 34 may be disposed at the workstation 12 to enable the workstation cooling system 10 to monitor a current temperature of the workstation 12, and adjust operations of the radiant cooling system 14 and/or the HVAC system 20 to maintain the target temperature of the workstation 12.

Figure 2:
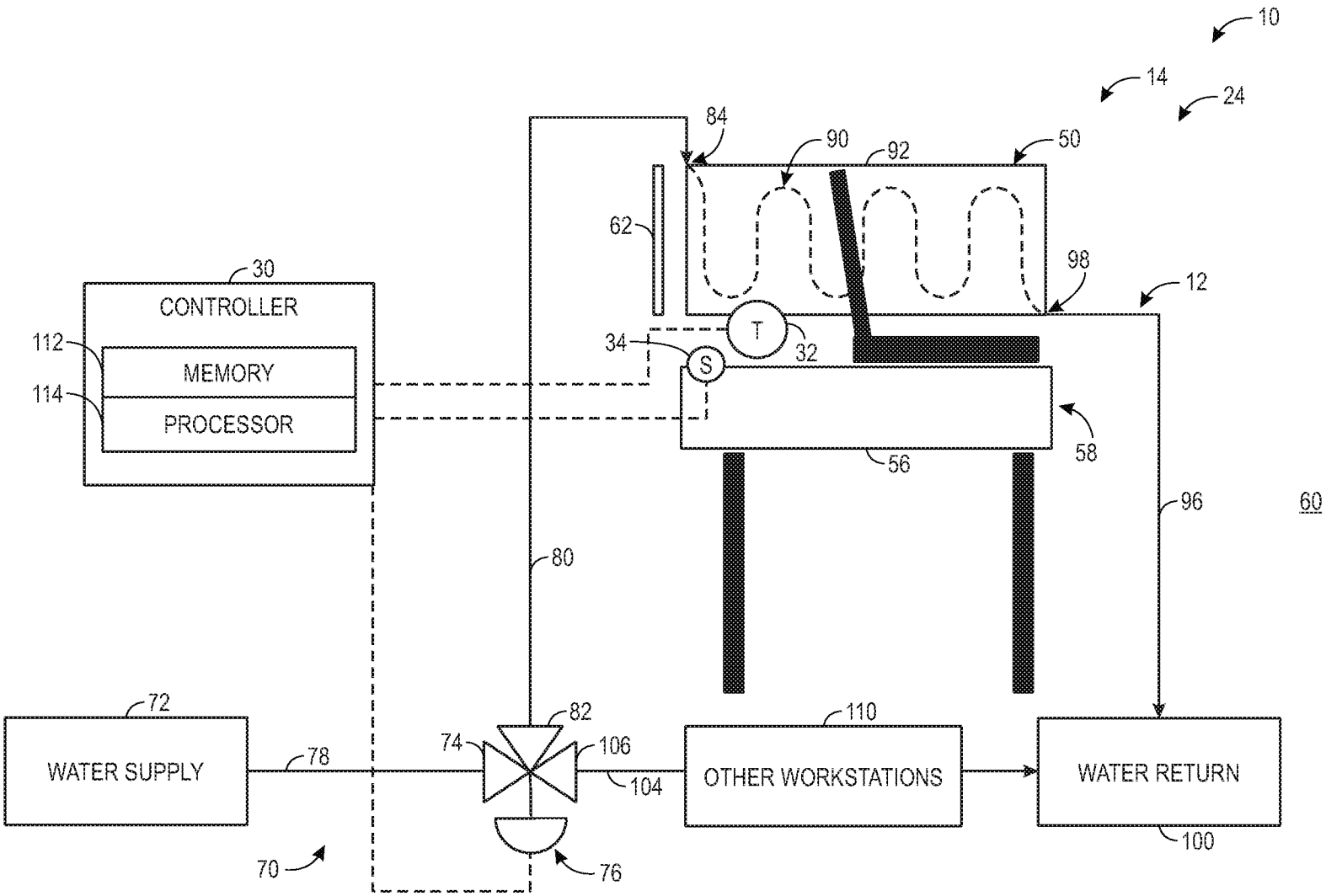
FIG. 2 illustrates a schematic diagram of the workstation cooling system of FIG. 1 having a radiant cooling system, in accordance with embodiments described herein.

FIG. 2 illustrates a schematic diagram of the workstation cooling system 10 having the radiant cooling system 14, in accordance with embodiments described herein. The illustrated radiant cooling system 14 includes a radiant panel 50 disposed at or in the workstation 12. Additionally, the illustrated workstation 12 may include a computer 54 disposed on top of a work surface 56 of a desk 58 of the workstation 12. The workstation 12 may include any suitable computer, desk, or other equipment that enables a user to perform work at the workstation 12. In the present embodiment, the radiant panel 50 is an acoustic or privacy panel of the workstation 12 that serves an additional function beyond air conditioning, such as acoustically and/or visually insulating a user at the workstation 12 from a surrounding environment 60. In additional or alternative embodiments, the radiant panel 50 may be embedded within the work surface 56 of the workstation 12, thus removing radiant energy directly from the user and/or the computer 54 when the user is performing work on the workstation. In embodiments in which the desk 58 is an adjusting and/or standing desk, the radiant panel 50 may be coupled to a suitable support structure, such as legs or a stand, which may enable the radiant panel 50 to remain in a static position even while the desk 58 is being moved, such as via vertical adjustments. Advantageously, mounting the radiant panel 50 on the support structure may reduce physical stress on electronic and/or fluid connections to the radiant panel 50.

By removing radiant energy near the user, the workstation-mounted radiant panels 40 may increase cooling efficiency of the workstation cooling system 10 because even small cooling adjustments from the radiant panel 50 may be sensed directly by the user. Additionally, in certain embodiments, multiple acoustic panels and/or other surfaces of the workstation 12 may operate as radiant panels 50, such as an illustrated back panel 62 or privacy panels of the workstation 12. In embodiments in which multiple radiant panels 50 are disposed in the workstation 12, even faster radiant cooling may be achieved.

In general, the radiant panel 50 may absorb radiant energy from the workstation 12 to maintain a target temperature of the workstation 12. For example, various radiant energy sources within a room 24 where the workstation 12 is disposed may increase the temperature of the workstation 12 by providing radiant energy to the room 24 and the workstation 12. The radiant energy sources may include, for example, an outside environment that is external to the room, lights, computing equipment such as the computer 54, users, and so forth. Because the radiant energy sources are at a higher temperature than the radiant panel 50, the radiant energy sources radiate energy, referred to herein as "radiant energy," to the radiant panel 50, thus removing sensible heat from the workstation 12. Additionally, via convection, the air within the room 24 contacts the radiant panel 50 and cools down, improving a comfort level of a user at the workstation 12.

Multiple components may operate cooperatively to enable the radiant panel 50 to continuously absorb radiant energy from the workstation 12. For example, as shown, a water supply system 70 provides cooling water through the radiant panel 50 as a heat sink for the radiant energy absorbed from the workstation 12. The illustrated water supply system 70 includes a water supply 72, such as a chilled water tank or another suitable cooling water source, which supplies cooling water for the radiant panel 50. More specifically, the water supply is fluidly coupled to a valve inlet 74 of a control valve 76 via a valve supply conduit 78. Additionally, a panel supply conduit 80 is fluidly coupled between a first outlet 82 of the control valve 76 and a panel inlet 84 of the radiant panel 50. Moreover, heat exchange coils 90 extend within a housing 92 or casing of the radiant panel 50 to absorb radiant energy from the workstation 12. The heat exchange coils 90 may be any suitable conduit for receiving and directing cooling water from the panel inlet 84 to a panel outlet 96, including flexible tubing, copper tubing, bare tubing, finned tubing, and so forth. The panel outlet 96 fluidly couples the heat exchange coils 90 to a panel return conduit 98, which is fluidly coupled between the panel outlet 96 and a water return 100. By providing cooling water from the water supply 72, through the radiant panel 50, and to the water return 100, the water supply system 70 enables the radiant panel 50 to continuously absorb radiant energy from the workstation 12 by transferring the radiant energy to the continuously-circulated cooling water. Moreover, a bypass conduit 104 is fluidly coupled between a second outlet 106 of the control valve 76 and the water return 100 to enable the cooling water to bypass the workstation 12 when less cooling is requested. However, in certain embodiments in which only one workstation 12 is disposed within the room 24, the bypass conduit 104 may be omitted, such that the control valve 76 moves between a closed position that does not provide cooling water to the workstation 12 and an open position that does. It should be understood that the water supply system 70 illustrated in FIG. 2 is only one example configuration of the disclosed water supply system 70, and any suitable configuration of the water supply system 70 that provides cooling water through the radiant panel 50 as a heat sink for the radiant energy absorbed from the workstation 12 is contemplated.

Additionally, the controller 30 discussed above may be communicatively coupled to the control valve 76, the thermostat 32, and/or the temperature sensor 34. The thermostat 32 and/or the temperature sensor 34 may each be disposed on, attached to, or mounted at the workstation 12. The controller 30 may instruct the control valve 76 to adjust the cooling water directed to and through the radiant panel 50. The controller 30 may operate according to a pre-programmed schedule and/or according to user input provided via the thermostat 32 and transmitted to the controller 30. That is, the thermostat 32 may be disposed at the workstation 12 to enable the user to instruct the controller 30 to adjust the flowrate of cooling water through the radiant panel 50. Additionally, to reduce condensation of water on the radiant panel 50, the radiant panel 50 may be maintained at a surface temperature that is above the dew point of water, such that convection of the air around the radiant panel 50 may generally remove sensible heat. In some embodiments, the convection of the air around the radiant panel 50 may generally remove sensible heat, but not latent heat from the air in contact with the radiant panel 50. In some embodiments, a temperature sensor is disposed near the radiant panel 50 to enable the controller 30 to directly monitor the surface temperature of the radiant panel 50.

In general, when a lower flowrate of cooling water is directed through the radiant panel 50, the cooling water travels slower through the heat exchange coils 90, thus absorbing less radiant energy as temperature of the cooling water increases due to a decreased temperature differential between the cooling water and the radiant energy sources. Alternatively, when a higher flowrate of cooling water is directed through the radiant panel 50, the cooling water travels faster through the heat exchange coils 90, resulting in a smaller temperature increase of the cooling water, and thus absorbing greater amounts of radiant energy. For example, if a first level of radiant cooling is requested, the controller 30 instructs the control valve 76 to open the first outlet 82 and enable cooling water to flow through the radiant panel 50. Then, if a second, greater level of radiant cooling is requested, the controller 30 may perform any suitable control action to increase the cooling water flow through the radiant panel 50, such as by instructing the control valve 76 to further open the first outlet 82, by instructing a pump to provide the cooling water at a greater flowrate, or the like. Additionally, if no radiant cooling of the workstation 12 is requested, the controller 30 may instruct the control valve 76 to close the first outlet 82 and to open the second outlet 106 of the control valve 76 to enable the cooling water to bypass the workstation 12 via the bypass conduit 104. In some embodiments, the cooling water bypasses the workstation 12 and proceeds to other workstations 110 having radiant panels 50 fluidly coupled between the water supply 72 and the water return 100 to enable the other workstations 110 to be cooled.

Moreover, the illustrated controller 30 may include a memory 112 and a processor 114. The processor 114 may be any type of suitable computer processor or microprocessor capable of executing computer-executable code. Additionally, the processor 114 may also include multiple processors that may perform the operations described herein. The memory 112 may be any suitable article of manufacture that can serve as media to store processor-executable code, data, or the like. These articles of manufacture may represent non-transitory, computer-readable media, such as any suitable form of memory or storage which may store the processor-executable code used by the processor 114 to perform the presently disclosed techniques. The memory 112 may also be used to store data, various other software applications, and the like. For example, the memory 112 may store the processor-executable code used by the processor 114 to perform various techniques described herein, as well as code for other techniques as well. It should be noted that non-transitory merely indicates that the media is tangible and not a signal.

Figure 3:
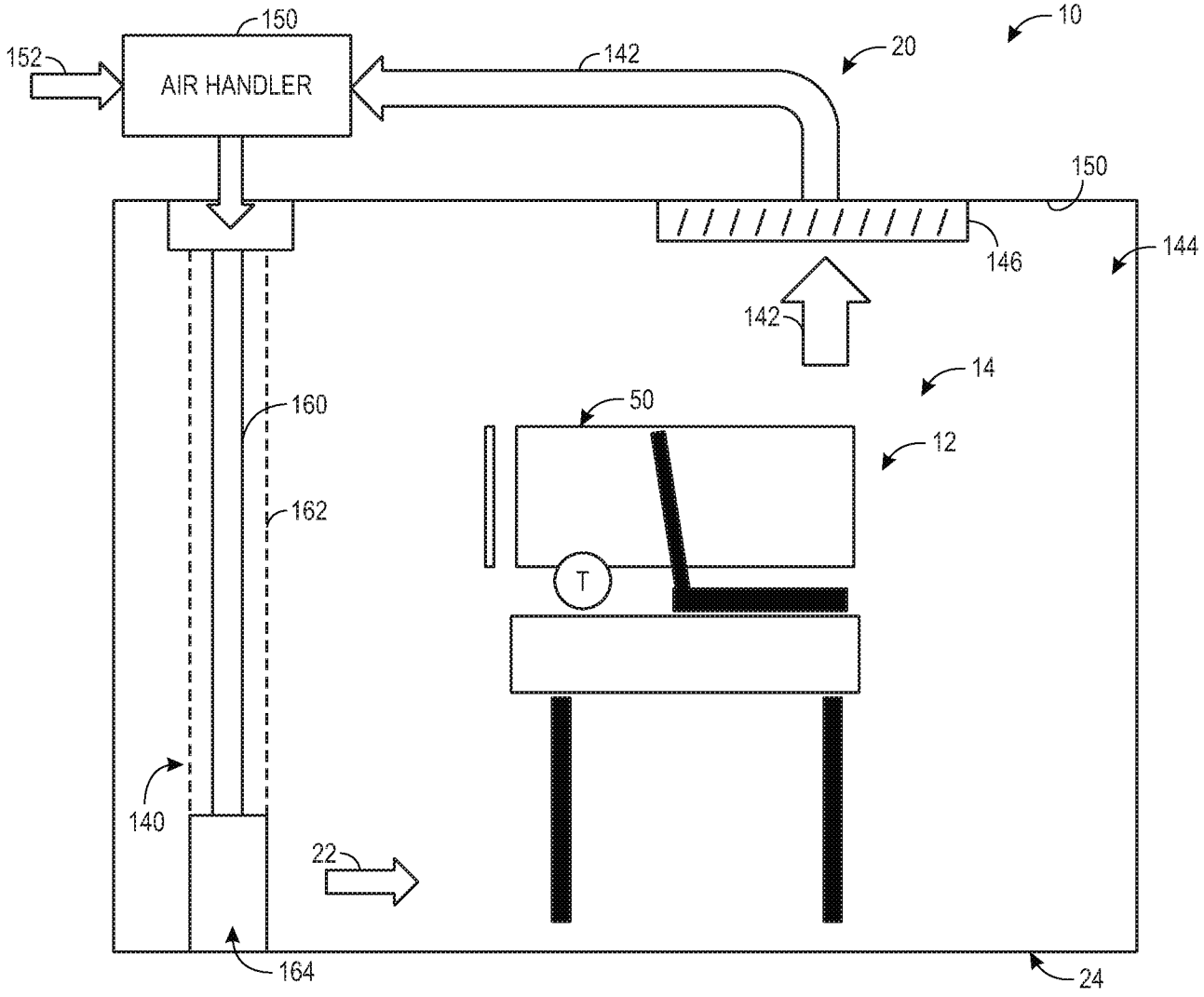
FIG. 3 illustrates a schematic diagram of the radiant cooling system of FIG. 2 operating with a heating, ventilation, and air conditioning (HVAC) system, in accordance with embodiments described herein.

FIG. 3 illustrates a schematic diagram of the workstation cooling system 10 having the radiant cooling system 14 operating with the HVAC system 20, in accordance with embodiments described herein. The radiant cooling system 14 may generally include the radiant panel 50 for absorbing the radiant energy 18 from the workstation 12, as well as the water supply system 70 discussed above. The HVAC system 20 may provide the conditioned air 22 to the room 24 having the workstation 12 for additional or large-scale conditioning of the workstation 12. In the present embodiment, the HVAC system 20 is a displacement air conditioning system that advantageously provides the conditioned air 22 to a lower portion 140 of the room 24 and removes return air 142 from an upper portion 144 of the room 24. In some embodiments, the lower portion 140 of the room 24 is defined as below or predominately below a horizontal midline of the room 24.

As illustrated, the HVAC system 20 collects the return air 142 through a return grill 146 disposed in a ceiling 148 of the room 24. The return air 142 is directed to an air handler 150 via ducts for conditioning. In some embodiments, the return air 142 is mixed with outside air 152 upstream of or within the air handler 150 for ventilation. Within the air handler 150, the return air 142 and the outside air 152 may travel over one or more heat exchange coils for cooling and/or dehumidification. Moreover, the air handler 150 may include suitable sterilization devices and filters that sterilize, filter, or otherwise clean the return air 142 and the outside air 152 to form the conditioned air 22. Once conditioned, the conditioned air 22 is provided through an air chase 160 disposed within a column 162 or a suitable wall of the room 24. A delivery opening 164 of the air chase 160 delivers the conditioned air 22 to the lower portion 140 of the room 24 at a low velocity, such as a velocity below 10 m/s. In some embodiments in which the room 24 includes raised floors, the air chase 160 delivers the conditioned air 22 via a suitable delivery opening disposed in the raised floors.

After delivery into the room 24, the conditioned air 22 may absorb thermal energy from the room 24 and/or the workstation 12, warming and rising on its way to the return grill 146. Thus, as the warmer air rises within the room 24, it is generally cooled by the radiant panel 50 via convection, as discussed above. Additionally, to maintain proper movement and stratification of air from the lower portion 140 to the upper portion 144 of the room 24, the radiant cooling system 14 may maintain suitable temperatures in the room 24 to avoid overcooling of the air, which may cause the rising air to fall and mix with incoming conditioned air 22. That is, by placing the radiant cooling system 14 closer to the delivery opening 164 of the air chase 160, the radiant cooling system 14 may remove thermal energy from the conditioned air 22 and/or remove radiant energy from the workstation 12 without disrupting desired stratification of air within the room 24. The embodied HVAC system 20 therefore provides a healthier environment to the room 24 by avoiding macroscopic mixing of the air within the room 24 during operation. In contrast, a traditional cooling system having radiant panels disposed in the ceiling may cool and cause warmed air within a room to fall back to a workstation without sterilization and/or filtering within an air handler of the traditional cooling system. However, it is contemplated that the workstation cooling system 10 may operate in conjunction with the radiant panels disposed in the ceiling by, for example, maintaining cooler temperatures at the lower portion 140 of the room 24 and warmer temperatures at the upper portion 144 of the room 24 to maintain proper movement and stratification of air in the room 24. As such, the present embodiments of the workstation cooling system 10 are capable of using both the radiant cooling system 14 and the HVAC system 20 in unison for providing healthy, conditioned air at an individually-selected target temperature to the workstation 12. Moreover, the embodied radiant cooling system 14 may supplement operation of the HVAC system 20, such that the HVAC system 20 may be operated more efficiently than HVAC systems that are not used in conjunction with radiant cooling systems to provide desirable energy savings.

Figure 4:
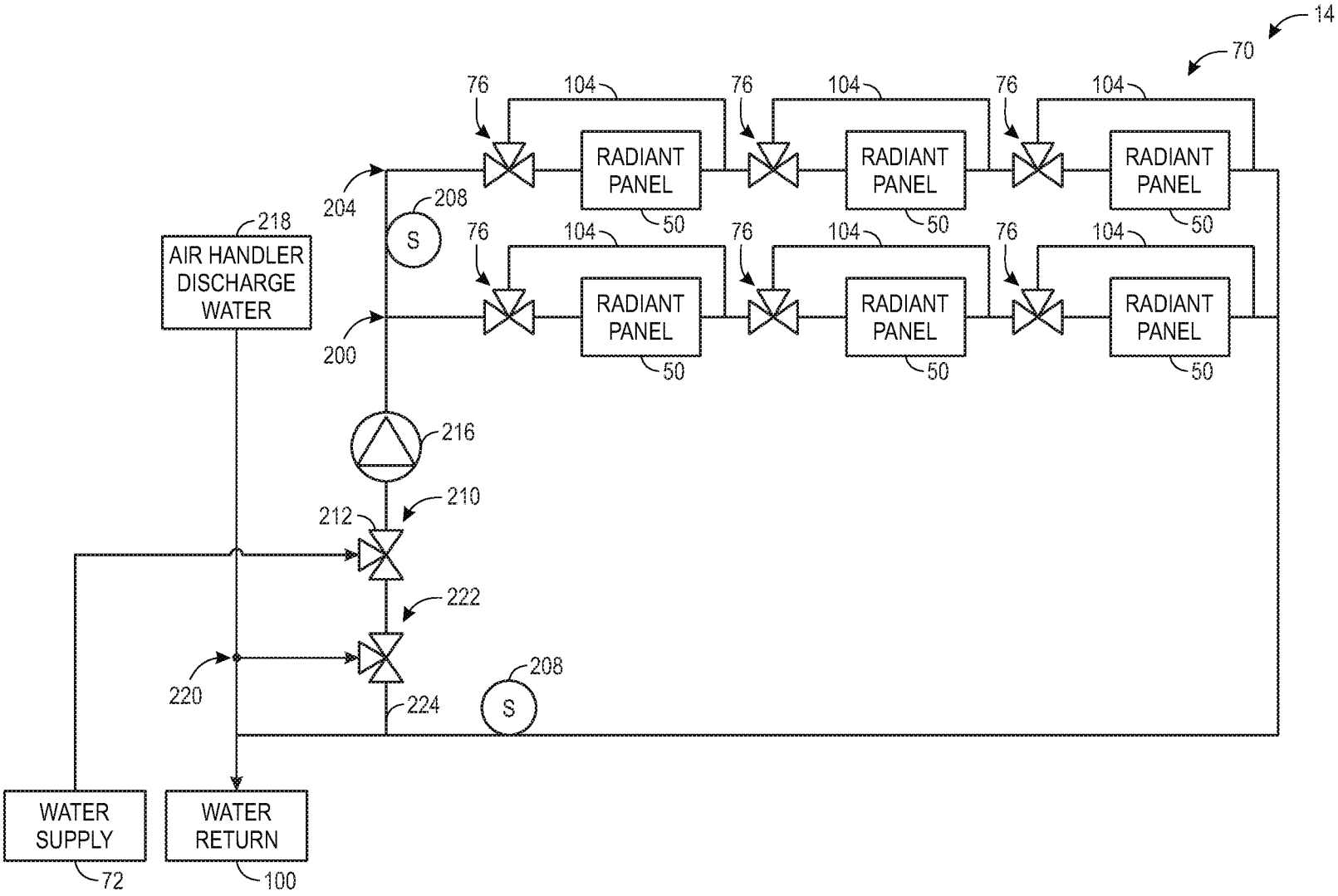
FIG. 4 illustrates a schematic diagram of a water supply system of the workstation cooling system of FIG. 1, in accordance with embodiments described herein.

FIG. 4 illustrates a schematic diagram of a water supply system 70 of the workstation cooling system 10, in accordance with embodiments described herein. As discussed above, the water supply system 70 may direct cooling water to one or more radiant panels 50 to remove the radiant energy 18 from the workstation 12. In the present embodiment, each radiant panel 50 is associated with one workstation 12. That is, six workstations 12 disposed in the room 24 are each individually conditioned by a respective radiant panel 50. As illustrated, the water supply system 70 includes a first series 200 of the radiant panels 50 connected in parallel with a second series 204 of the radiant panels 50. Each series 200, 204 includes three radiant panels 50. However, any suitable number of radiant panels 50 may be selected for any number of workstations 12 in any suitable configuration according to the techniques disclosed herein. For example, in some embodiments, two or more radiant panels 50 are disposed at a single workstation 12, one radiant panel 50 may be disposed between two workstations 12, and so forth.

The controller 30 discussed above may control the flow of cooling water through each control valve 76 based on user input received via respective thermostats 32 disposed at each workstation 12, based on sensor feedback received from temperature sensors disposed at each workstation 12 and/or within the room 24, or a combination thereof. Moreover, in the illustrated embodiment of the water supply system 70, temperature sensors 208 may be disposed along conduits of the water supply system 70 for directly sensing a temperature of the water therein. The controller 30 discussed herein may employ the sensed temperatures for adjusting parameters of the cooling water supplied to the radiant panels 50, including temperatures, flowrates, pressures, and more.

When cooling of at least one workstation 12 is requested, the water supply system 70 may direct cooling water from the water supply 72 to a water supply valve 210. The water supply valve 210 may control a flow of the cooling water that is directed to the series 200, 204 of the radiant panels 50. Thus, when cooling is requested, a first outlet 212 of the water supply valve 210 may be opened to enable the cooling water to flow to a pump 216. The pump 216 may pressurize or otherwise motivate the cooling water to flow through the radiant panels 50 of the series 200, 204. As discussed above, each control valve 76 for each radiant panel 50 may individually adjust an amount of cooling water supplied to each radiant panel 50. For example, if each radiant panel 50 of the first series 200 of radiant panels 50 is requested to cool its respective workstation 12, each control valve 76 of the first series 200 may be turned to an open position that directs the cooling water through the heat exchange coils of each radiant panel 50 of the first series 200. Additionally, if none of the radiant panels 50 of the second series 204 of radiant panels 50 is requested to cool their respective workstations 12, the control valve 76 associated with a first radiant panel 50 of the second series of radiant panels 50 may be closed, such that no cooling water flows through the second series. As a further example, if only the first radiant panel 50 of the second series 204 is requested to cool the respective workstation 12, the control valves 76 of the second series 204 may cooperate to direct cooling water through the first radiant panel 50, and then through the bypass conduits 104 associated with the second and third radiant panels 50 of the second series 204.

After flowing through one or both of the series 200, 204 of the radiant panels 50, the cooling water from each series 200, 204 rejoins and travels to the water return 100. Additionally, in some embodiments, air handler discharge water 218 is directed to a split 220. The air handler discharge water 218 may be condensation collected during conditioning of the workstation 12. At the split 220, the air handler discharge water 218 may be directed either directly to the water return 100 or to an air handler discharge water valve 222. In some embodiments, the air handler discharge water valve 222 receives cooling water from the water supply 72 and mixes the cooling water with the air handler discharger water 218. The water mixture may then travel along a supplemental return conduit 224 to the water return 100. However, in some embodiments, the air handler discharge water 218 is directed through the air handler discharge water valve 222, through the water supply valve 210, and to the radiant panels 50 as additional cooling water to increase a cooling efficiency of the radiant cooling system 14.

Figure 5:
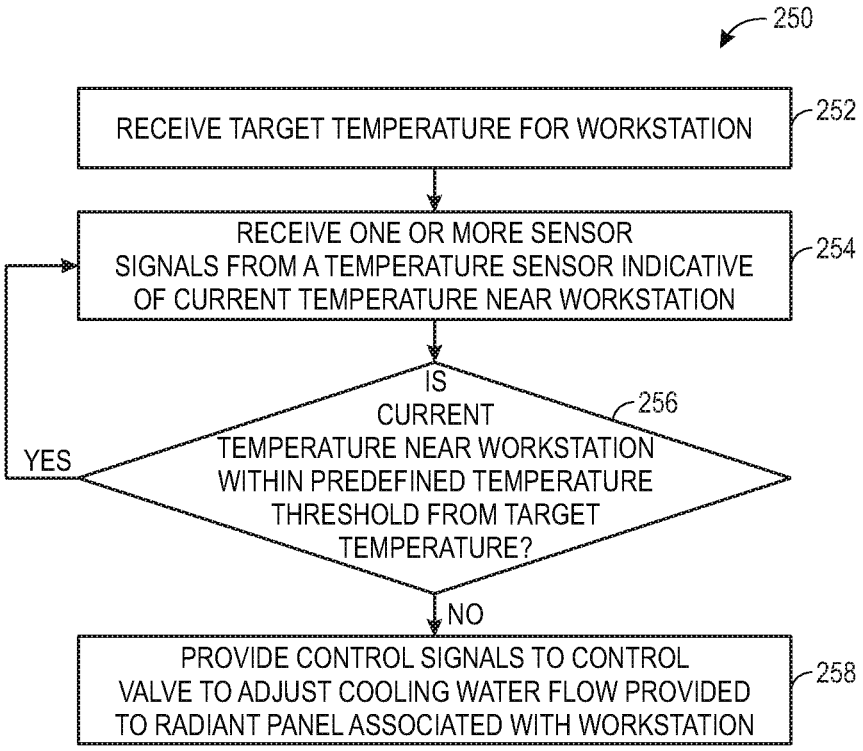
FIG. 5 illustrates a flow chart of a method for operating the workstation cooling system of FIG. 1 to condition the workstation, in accordance with embodiments described herein.

FIG. 5 illustrates a flow chart of a method 250 for operating the workstation cooling system 10 to condition the workstation 12, in accordance with embodiments described herein. Although the following description of the method 250 is described in a particular order, which represents a particular embodiment, it should be noted that the method 250 may be performed in any suitable order or certain steps may be skipped altogether. Moreover, although the following description of the method 250 is described as being performed by the controller 30 of the workstation cooling system 10, it should be noted that the method 250 may be performed by any suitable computing device.

Referring now to FIG. 5, at block 252, the controller 30 receives a target temperature for the workstation 12. The target temperature may be set by a building manager or by a user at the workstation 12 via a user input device such as the thermostat 32. Additionally, in some embodiments, the user may request that more or less cooling than a current amount of cooling be provided via the radiant cooling system 14. For example, the user input device may enable he user to increase the current temperature, decrease the current temperature, and/or maintain the current temperature, without expressly setting the target temperature. In some embodiments, a range of acceptable temperatures that the user may request may be set by the building manager or another administrator of the workstation 12. For example, the building manager may limit the user's requested target temperature for the workstation 12 to be any suitable temperature range, such as a range defined between 65 and 75 degrees Fahrenheit, 60 and 80 degrees Fahrenheit, or the like.

At block 254, the controller 30 receives one or more sensor signals from the temperature sensor 34 indicative of the current temperature near the workstation 12. For example, the temperature sensor 34 disposed at the workstation 12 may transmit signals to the controller 30 indicative of the current temperature of the workstation 12. The sensor signals may be sent continuously, at regular intervals, once a change in temperature is detected, and/or upon request by the controller 30. As such, the controller 30 may use the sensor signals from the temperature sensor 34 to determine the current temperature near the workstation 12.

At block 256, the controller 30 determines whether the current temperature near the workstation 12 is within predefined temperature threshold from the target temperature. For example, the predefined temperature threshold may be any suitable range of degrees, for example, between 0.5 to 10 degrees Fahrenheit, surrounding or framing the target temperature. Thus, in some embodiments, the predefined temperature threshold may be 0.5 degrees Fahrenheit, 1 degree Fahrenheit, 10 degrees Fahrenheit, or the like, both above and below the target temperature. In response to determining that the current temperature is within the predefined temperature threshold from the target temperature, the controller 30 may return to block 254 to continue receiving sensor signals indicative of the current temperature near the workstation 12.

At block 258, in response to determining that the current temperature is not within the predefined temperature threshold from the target temperature, the controller 30 provides control signals to the control valve 76 to adjust the cooling water flow provided to the radiant panel 50 associated with the workstation 12. As discussed above, one or more radiant panels 50 may be associated with one or more workstations within the room 24. Thus, if the workstation 12 has a current temperature that is above the target temperature by more than the predefined temperature threshold, the controller 30 may instruct the control valve 76 to direct more cooling water through the one or more radiant panels 50 to decrease the temperature of the workstation 12. Alternatively, if the workstation has a current temperature that is below the target temperature by more than the predefined temperature threshold, the controller 30 may instruct the control valve 76 to direct less cooling water through the one or more radiant panels 50 to increase the temperature of the workstation 12. In this manner, the radiant panels 50 can individually condition their respective workstations 12 to desired target temperatures. Moreover, in some embodiments in which a threshold quantity of the workstations 12 are above or below their target temperatures, the controller 30 may coordinate operation of the HVAC system 20 with the radiant cooling system 14 for more large-scale conditioning of the workstations 12. For example, if the threshold quantity of the workstations 12 are above their target temperatures, the controller 30 may instruct the HVAC system 20 to decrease the temperature in the room 24 where the workstations 12 are located, and vice versa.

While only certain features of disclosed embodiments have been illustrated and described herein, many modifications and changes will occur to those skilled in the art. It is, therefore, to be understood that the appended claims are intended to cover all such modifications and changes as fall within the true spirit of the present disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A workstation cooling system, comprising:

a radiant panel configured to be disposed in a workstation within a lower portion of a room;

a water supply conduit configured to provide a cooling water flow to an inlet of the radiant panel;

a water return conduit configured to receive the cooling water flow from an outlet of the radiant panel;

a control valve configured to adjust the cooling water flow provided to the radiant panel to enable the radiant panel to absorb heat to maintain a target workstation temperature of the workstation;

a displacement heating, ventilation, and/or air conditioning (HVAC) system comprising:

a delivery opening disposed in the lower portion of the room and configured to supply conditioned air thereto; and a return grill disposed in an upper portion of the room and configured to remove return air therefrom; and a controller configured to operate the displacement HVAC system and the control valve to maintain the target workstation temperature while maintaining a target room temperature that preserves movement of air from the lower portion of the room to the upper portion of the room.

2. The workstation cooling system of claim 1, wherein the controller comprises a processor configured to send control signals to the control valve to adjust the cooling water flow provided to the radiant panel.

3. The workstation cooling system of claim 2, comprising a temperature sensor coupled to the workstation, wherein the processor is configured to:

receive one or more sensor signals from the temperature sensor indicative of a current workstation temperature of the workstation;

determine whether the current workstation temperature is within a predefined temperature threshold from the target workstation temperature; and provide the control signals to the control valve to adjust the cooling water flow provided to the radiant panel in response to determining that the current workstation temperature is not within the predefined temperature threshold.

4. The workstation cooling system of claim 1, wherein the displacement HVAC system comprises an air chase having the delivery opening disposed in the lower portion of the room, and wherein the lower portion of the room is defined below a horizontal midline of the room.

5. The workstation cooling system of claim 1, wherein the controller comprises a processor communicatively coupled to a thermostat, and wherein the processor is configured to provide first control signals to adjust the cooling water flow provided to the radiant panel and configured to provide second control signals to control the displacement HVAC system based on user input provided to the thermostat.

6. The workstation cooling system of claim 1, comprising a water bypass conduit coupled between the control valve and the water return conduit, wherein the control valve is configured to enable the cooling water flow to bypass the workstation via the water bypass conduit.

7. The workstation cooling system of claim 1, comprising:

an additional radiant panel fluidly coupled to the radiant panel and disposed in an additional workstation; and an additional thermostat physically coupled to the additional workstation and communicatively coupled to the additional radiant panel, wherein the additional thermostat is configured to set an additional target workstation temperature for the additional workstation based on additional user input.

8. The workstation cooling system of claim 1, wherein the controller comprises a processor configured to bound the target workstation temperature within a predetermined temperature range that is updated based on administrative user input.

9. A workstation cooling system, comprising:

a plurality of radiant panels, wherein each radiant panel of the plurality of radiant panels is configured to be disposed within a lower portion of a room in a respective workstation of a plurality of workstations;

a water supply system, comprising:

a plurality of conduits fluidly coupling each radiant panel of the plurality of radiant panels in series;

a plurality of bypass conduits, wherein each bypass conduit of the plurality of bypass conduits fluidly couples adjacent conduits of the plurality of conduits;

a plurality of control valves, wherein each control valve is operatively coupled at a junction between a respective conduit and a respective bypass conduit, and wherein each control valve of the plurality of control valves is configured to adjust a cooling water flow provided between a respective bypass conduit of the plurality of bypass conduits and a respective radiant panel of the plurality of radiant panels to enable the respective radiant panel to exchange heat with the respective workstation;

a displacement heating, ventilation, and/or air conditioning (HVAC) system comprising:

a delivery opening disposed in the lower portion of the room and configured to supply conditioned air thereto; and a return grill disposed in an upper portion of the room and configured to remove return air therefrom; and a controller communicatively coupled to the plurality of control valves and the displacement HVAC system, wherein the controller is configured to provide control signals to adjust the plurality of control valves and the displacement HVAC system to maintain an individualized target workstation temperature of the respective workstation while maintaining a target room temperature that preserves movement of air from the lower portion of the room to the upper portion of the room.

10. The workstation cooling system of claim 9, wherein the plurality of radiant panels is a first plurality of radiant panels coupled in series, wherein the workstation cooling system comprises a second plurality of radiant panels coupled in series, wherein each radiant panel of the second plurality of radiant panels is configured to be disposed in an additional respective workstation, and wherein the first plurality of radiant panels is fluidly coupled in parallel with the second plurality of radiant panels.

11. The workstation cooling system of claim 9, comprising a plurality of thermostats communicatively coupled to the plurality of control valves, wherein each thermostat of the plurality of thermostats is configured to instruct a respective control valve of the plurality of control valves to adjust the cooling water flow therethrough based on user input.

12. The workstation cooling system of claim 9, wherein the controller is configured to actuate the plurality of control valves according to a pre-programmed schedule to adjust the cooling water flow provided to each radiant panel of the plurality of radiant panels.

13. The workstation cooling system of claim 9, wherein the displacement HVAC system comprises an air handler configured to generate the conditioned air and provide the conditioned air to the lower portion of the room comprising the plurality of radiant panels.

14. The workstation cooling system of claim 13, comprising:

a plurality of thermostats respectively coupled to each workstation of the plurality of workstations and configured to receive user input indicative of the individualized target workstation temperature, wherein the controller is communicatively coupled to the plurality of thermostats, and wherein the controller is configured to adjust the displacement HVAC system to perform large-scale conditioning of the room by adjusting the target room temperature in response to determining that a threshold quantity of the plurality of workstations is not within a predefined temperature threshold from the individualized target workstation temperature.

15. A workstation conditioning system, comprising:

a displacement heating, ventilation, and/or air conditioning (HVAC) system comprising:

a delivery opening disposed in a lower portion of a room and configured to supply conditioned air thereto; and a return grill disposed in an upper portion of the room and configured to remove return air therefrom;

a radiant panel disposed in a workstation within the lower portion of the room;

a control valve or pump configured to manage fluid flow through the radiant panel to adjust transfer of radiant energy between the radiant panel and the workstation; and a controller having a processor and communicatively coupled to the displacement HVAC system and the control valve or pump, wherein the processor is configured to provide control signals to adjust the displacement HVAC system and the control valve or pump to maintain a target workstation temperature of the workstation while maintaining a target room temperature that preserves movement of air from the lower portion of the room to the upper portion of the room.

16. The workstation conditioning system of claim 15, wherein the control valve control valve or pump is configured to adjust a water flow provided through the radiant panel.

17. The workstation conditioning system of claim 15, comprising an acoustic panel, wherein the acoustic panel comprises the radiant panel.

18. The workstation conditioning system of claim 15, wherein the movement of the air from the lower portion of the room to the upper portion of the room facilitates stratification of the air within the room and reduce recirculation of contaminants within the room.

19. The workstation conditioning system of claim 18, wherein the displacement HVAC system is configured to direct the conditioned air through the delivery opening to be cooled near the workstation by the radiant panel, absorb heat from heat sources within the workstation, and exit the room through the return grill.

20. The workstation conditioning system of claim 15, comprising a privacy panel, and wherein the privacy panel comprises the radiant panel.

* * * * *